US005295879A

United States Patent [19]

Meier et al.

[11] Patent Number: 5,295,879

[45] Date of Patent: Mar. 22, 1994

[54] SOUND DEADENING PAD FOR AN OUTBOARD MOTOR

[75] Inventors: Peter W. Meier, Stuart, Fla.; Chris W. Slater, Johns, V.I.

[73] Assignee: Outboard Marine Corporation, Waukegan, Ill.

[21] Appl. No.: 915,793

[22] Filed: Jul. 17, 1992

Related U.S. Application Data

[63] Continuation of Ser. No. 665,017, Mar. 5, 1991, abandoned.

[51] Int. Cl.[5] ..... B63H 21/36

[52] U.S. Cl. ..... 440/77; 440/52; 440/89

[58] Field of Search ..... 440/52, 76, 77, 78, 440/89

[56] References Cited

U.S. PATENT DOCUMENTS

| | | | |
|---|---|---|---|
| 2,209,301 | 7/1940 | Johnson et al. | 440/52 |
| 2,585,774 | 2/1952 | Heidner et al. | 440/52 |
| 2,890,675 | 6/1959 | Rose | 440/52 |
| 2,909,031 | 10/1959 | Kiekhaefer | 440/52 |
| 3,090,463 | 5/1963 | Yanda | 181/33 |
| 3,195,530 | 7/1965 | Heidner | 123/198 |
| 3,269,350 | 8/1966 | Stibbe et al. | 440/52 |
| 3,557,902 | 1/1971 | Brown et al. | 181/35 |
| 3,599,594 | 8/1971 | Talpale | 115/17 |
| 3,750,615 | 8/1973 | Haft et al. | 440/89 |
| 3,961,595 | 6/1976 | Meyer | 440/52 |
| 4,507,090 | 3/1985 | Kobayashi et al. | 440/52 |
| 4,583,953 | 4/1986 | Nakase | 440/52 |
| 4,604,069 | 8/1986 | Taguchi | 440/89 |
| 4,723,926 | 2/1988 | Uehara | 440/52 |
| 4,795,383 | 1/1989 | Binversie et al. | 440/89 |

FOREIGN PATENT DOCUMENTS

| | | | |
|---|---|---|---|
| 121393 | 10/1978 | Japan | 440/52 |
| 4497 | 1/1982 | Japan | 440/52 |
| 128094 | 7/1985 | Japan | 440/52 |
| 74496 | 3/1990 | Japan | 440/89 |
| 127188 | 5/1990 | Japan | 440/52 |

OTHER PUBLICATIONS

*Johnson Outboard Parts Catalog*, pp. 6–4.

Johnson 1973 Parts Catalog, p. 20.

*Primary Examiner*—Michael S. Huppert

*Assistant Examiner*—Thomas J. Brahan

*Attorney, Agent, or Firm*—Michael, Best & Friedrich

[57] ABSTRACT

A marine propulsion device having a powerhead drivingly connected to a propeller shaft, a lower unit rigidly connected to the powerhead and supporting the propeller shaft, a swivel bracket spaced from the lower unit and the powerhead and adapted to allow pivotal movement of the powerhead and the lower unit around a generally vertical steering axis, a connecting link between the swivel bracket and one of the powerhead and the lower unit, a portion of the link being spaced from the powerhead, and a pad for deadening noise generated by the powerhead, the pad being adjacent the link and at least partially filling the space between the link and the powerhead.

15 Claims, 1 Drawing Sheet

SOUND DEADENING PAD FOR AN OUTBOARD MOTOR

This is a continuation of co-pending application Ser. No. 665,017, filed Mar. 5, 1991 now abandoned.

BACKGROUND OF THE INVENTION

The invention relates to a means for reducing the sound pressure emitted from the powerhead and lower unit area of an outboard motor.

Other means for either reducing the sound emitted from an outboard motor or reducing the vibration caused by the operation of the motor are shown in the following patents:

| Patent No. | Inventor(s) | Issue Date |
|---|---|---|
| 3,090,463 | Yanda, J. D. | 5/21/63 |
| 3,195,530 | Heidner, R. C. | 5/31/62 |
| 3,557,902 | Brown, N. F.<br>Stulac, J. F. | 1/26/71 |
| 3,599,594 | Taipale, D. L. | 8/17/71 |
| 4,723,926 | Hidehiko, U. | 2/9/88 |

Additional means are shown in the following publications:

1. *Johnson Outboard Parts Catalog*, Page 6–4, for the exhaust housing of a 1971, 9.5 hp motor (PN 385065); and, 2. *Johnson* 1973 *Parts Catalog*, for 50 hp outboard motor, page 20, (PN 386136).

SUMMARY OF THE INVENTION

The invention comprises a marine propulsion device having a powerhead drivingly connected to a propeller shaft, a lower unit rigidly connected to the powerhead and supporting the propeller shaft, a swivel bracket spaced from the lower unit and the powerhead and adapted to allow pivotal movement of the powerhead and the lower unit around a generally vertical steering axis, a connecting link between the swivel bracket and either of the powerhead or the lower unit, with a portion of the link spaced from the powerhead, and means for deadening noise generated by the powerhead, the noise deadening means adjacent the link and at least partially filling the space between the link and the powerhead.

In one embodiment, the noise deadening means comprises a resilient pad or blanket which surrounds a portion of the link.

In one embodiment, the marine propulsion device also has an exhaust housing cover in surrounding relation to the upper portion of the lower unit, with the upper portion of the exhaust housing cover being spaced from the lower unit, and the resilient pad at least partially fills the space between the exhaust housing cover and the lower unit.

In another embodiment, the marine propulsion device also has a lower engine cover in surrounding relation to the powerhead and spaced from the link, and the resilient pad at least partially fills the space between the lower engine cover and the link.

In one embodiment, the link comprises a pair of steering arm forks connected to a rubber mount assembly, and the resilient pad has a pair of apertures through which the forks extend.

The invention also comprises a device for propelling a boat comprising a powerhead, a lower unit rigidly connected to the powerhead, an apparatus for mounting the powerhead and the lower unit to the boat and allowing pivotal steering movement of the powerhead and the lower unit with respect to the boat, a link connecting them mounting apparatus to one of the powerhead and the lower unit so that the mounting apparatus is in spaced relation to the powerhead and the lower unit, and a sound deadening means comprising a resilient pad at least partially filling the space between the mounting apparatus and the powerhead or the lower unit.

The invention also comprises a marine propulsion device having a powerhead drivingly connected to a propeller shaft adapted to drive a boat, a lower unit rigidly connected to the powerhead and supporting the propeller shaft, an exhaust housing cover in surrounding relation to the upper portion of the lower unit, the upper portion of the exhaust housing cover being spaced from the lower unit, a mounting apparatus for mounting the lower unit and the powerhead to the boat, the mounting apparatus comprising a resilient link having one end attached to either the powerhead or the lower unit, and means for deadening noise generated by the powerhead comprising a resilient pad positioned adjacent the link and at least partially filling the space between the exhaust housing cover and the lower unit.

Figure 1:
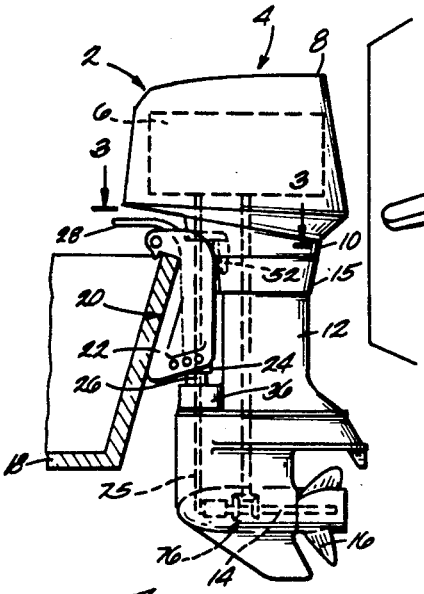
FIG. 1 is a side elevational view of a outboard motor incorporating the invention.
Figure 2:
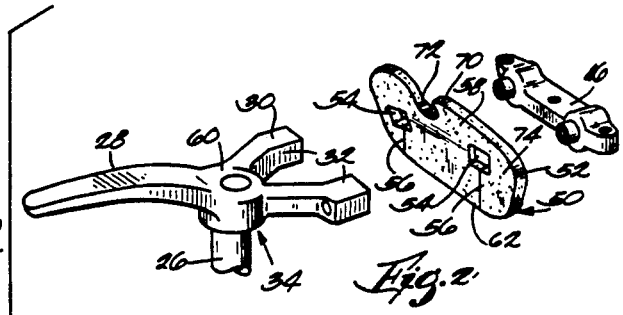
FIG. 2 is an exploded view of certain details of the invention including a portion of the connecting link and the resilient pad.

Before explaining one embodiment of the invention in detail, it is to be understood that the invention is not limited in its application to the details of the construction and the arrangements of the components set forth in the following description illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is a marine propulsion device 2 in the form of an outboard motor 4. The outboard motor comprises a powerhead 6 substantially enclosed in an upper motor cover 8 and a lower motor cover 10. The powerhead sits upon and is rigidly connected to a lower unit 12 which also rotatably supports a propeller shaft 14. In one embodiment, an exhaust housing cover 15 substantially surrounds and is in spaced relation to the upper portion of the lower unit 12. The propeller shaft is connected to a propeller 16. By this construction the powerhead 6 drives the propeller 16 to propel the boat 18 upon which the outboard motor is mounted through the water. The covers 8, 10 and 15 act to capture much of the noise generated by the powerhead.

Figure 4:
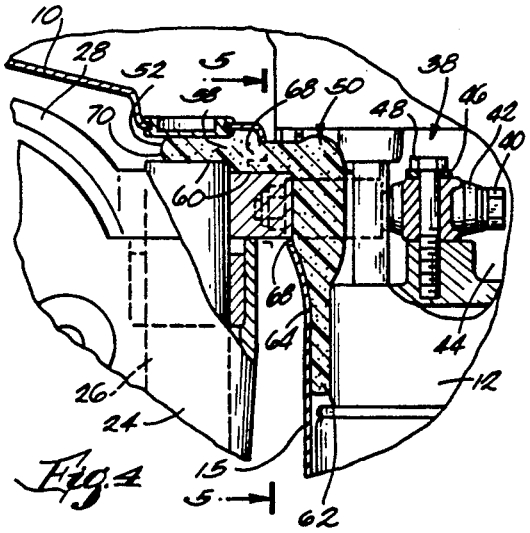
FIG. 4 is a sectional view, partially broken away, of FIG. 3 taken along line 4-4.

In a preferred embodiment, the outboard motor is mounted on the boat by a mounting means 20 which comprises in part a stern bracket 22, a swivel bracket 24 (better shown in FIG. 4) and a kingpin 26. The swivel bracket pivots with respect to the stern bracket about a substantially horizontal tilt axis to allow tilting movement of the outboard motor 4. The kingpin 26 pivots within the swivel bracket 24 about a substantially vertical steering axis to allow steering movement of the outboard motor 4. At its upper end, the kingpin 26 is rigidly connected to a tiller arm 28 and a connecting link 30. In a preferred embodiment, the connecting link 30 comprises a pair of steering arm forks 32 which are rigidly connected to the tiller arm 28 and the kingpin 26 to create a steering arm assembly 34.

In a preferred embodiment, the outboard motor 4 is connected to the mounting means 20 at the upper end of the kingpin 26 by the steering arm assembly 34 and also at the lower end of the kingpin 26 by a lower mounting means 36. The steering arm assembly 34 is connected to the lower unit 12 by a resilient upper mounting means 38. The resilient upper mounting means comprises a pair of horizontal bolts 40 connecting the steering arm forks 32 to resilient rubber mounts 42. The resilient rubber mounts 42, in turn are captured in recesses 44 in the lower unit by a connecting plate 46 and vertical bolts 48. By this construction, vibration caused by the powerhead and transmitted to the lower unit is attenuated by the rubber mounts 42 before reaching the tiller arm 28 or the boat 18. In another embodiment, the recesses 44 may be in the lower portion of the powerhead 6 or in an adapter plate (not shown) which could be used to connect the powerhead 6 to the lower unit 12. The lower mounting means 36 resiliently connects the lower portion of the kingpin to the lower unit 12 at the lower portion of the lower unit 12. By this arrangement, the powerhead 6 and lower unit 12 are afforded pivotal steering movement with respect to the mounting means 20 and boat 18.

In addition to creating unwanted vibration, the powerhead 6 also creates noise through the flow and combustion of gases and movement of the mechanical parts that make up the powerhead. The combustion exhaust gases are vented at idle though an exhaust idle relief muffler system (not shown) in the lower unit and at high speeds though the hub of the propeller 16 and into the water. Both the idle exhaust system and the through-hub exhaust act to deaden the exhaust noise created by the outboard. The noise generated by the gas flow and the moving mechanical parts is substantially captured by the upper motor cover 8, the lower motor cover 10, and the exhaust housing cover 15. However, since the rubber mounts 42 are resilient, they allow for some lateral and rotational movement of the powerhead 6 and the lower unit 12 and their respective covers 8, 10 and 15 with respect to the connecting link 30 and the swivel bracket. Accordingly, the lower motor cover 10 and the exhaust housing cover 16 cannot be made to fit snugly around the connecting link 30. Instead, a small open space 68 substantially surrounds the link 30, and through this space noise generated by the powerhead can escape from between the covers and the powerhead and lower unit. Although this space is relatively small, since it is at the front side of the outboard 4, any noise that is emitted travels forwardly, to the operator in the boat 18.

In order to reduce the emission of noise from the above described space 68, or deaden the noise coming from the outboard, the invention comprises a noise deadening means 50 in the area adjacent the link 30. In a preferred embodiment, this noise deadening means 50 comprises a resilient foam pad or blanket 52 which is positioned in the area around the link 30 and forks 32 and between the swivel bracket 24 and link 30 and the bottom of the powerhead 6 and the front of the lower unit 12.

Figure 3:
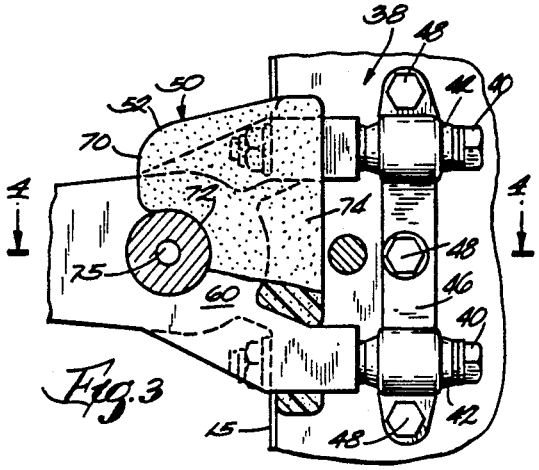
FIG. 3 is a sectional view, partially broken away, of FIG. 1 taken along line 3—3.
Figure 5:
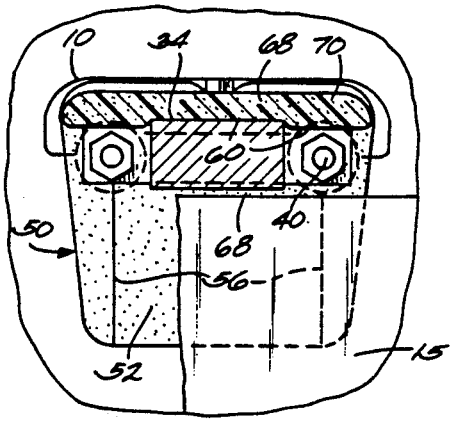
FIG. 5 is a sectional view, partially broken away, taken along line 5—5 of FIG. 4.

Specifically, in a preferred embodiment, the resilient pad 52 is roughly rectangular in shape and has a pair of apertures 54 cut out of its central portion 74. The pad also contains a pair of slits 56 from one outer edge to the apertures 54 so that the pad can be placed in surrounding relation to the forks 32 of the steering assembly 34 after the assembly has been built up. The pad also comprises an upper portion 58 which, in a preferred embodiment, resiliently fits horizontally into the space between the upper surface 60 of the steering assembly 34, including the link 30 and accordingly the upper end of the swivel bracket, 24 and the lower surface of the lower motor cover 10. The top edge 70 of the pad 52 has a semi-circular notch or cut out 72 so that the pad 52, when in the position shown in FIGS. 3 through 5 does not interfere with the vertical shift rod 75 which runs though the kingpin 26 to operate the transmission 76.

The pad also comprises a lower portion 62 which in a preferred embodiment, at least partially fills the space between the lower unit 12 and the upper portion 64 of the exhaust housing cover 15, and is positioned essentially vertically. The lower portion 62 of the pad accordingly also at least partially fills the space between the lower unit 12 and the swivel bracket 24. Between the upper portion 58 and the lower portion 62 of the pad is a central portion 74 in which the apertures are cut and which is bent at approximately a right angle to allow for the positioning of the upper and lower portions as described above. In another embodiment, the lower motor cover 10 may have a lower depending portion which could be substituted for the exhaust housing cover 15 and cover the upper portion of the lower unit 12. The lower portion 62 of the resilient pad 52 would be captured between this depending portion and the lower unit 12.

By this construction, the sound deadening means 50, in the form of a resilient pad 52 essentially fills the space 68 adjacent the link 30, the lower motor cover 10 and exhaust housing cover 15 which had heretofore been open to allow for the slight movement of the powerhead 6 and lower unit 12 necessitated by the use of the rubber mounts 42 in the resilient upper mounting means 38. Moreover, the pad 52 is kept in place by being squeezed by the exhaust housing cover 66 against the lower unit 12. As stated earlier, since this area is at the front end of the outboard motor, noise generated by the powerhead had previously been allowed to escape from inside the covers in this area and had been directed to the operator of the boat. Tests have shown over a 2dBa reduction in sound pressure at the operator's ear by the installation of the above described noise deadening means.

Various features of the invention are set forth in the following claims:

I claim:

1. A marine propulsion device comprising a rigid assembly including a powerhead, and a lower unit rigidly connected to said power head and supporting a propeller shaft driven by said powerhead, a swivel bracket spaced from said rigid assembly and adapted to allow pivotal movement of said rigid assembly around a generally vertical steering axis, a steering linkage between said swivel bracket and said rigid assembly and including a portion spaced forwardly from said lower unit, and means including a resilient pad located forwardly of said lower unit and substantially surrounding and engaging said portion of said linkage for deadening noise generated by said power head and at least partially filling the space between said linkage portion and said rigid assembly.

2. The marine propulsion device of claim 1 wherein said noise deadening means at least partially fills the space between said swivel bracket and said lower unit.

3. The marine propulsion device of claim 1 wherein said connecting link is resilient and attenuates vibration caused by said powerhead.

4. The marine propulsion device of claim 3 wherein said lower unit includes an upper portion and wherein said device also includes an exhaust housing cover located in surrounding relation to said upper portion of said lower unit and having an upper portion spaced forwardly from said lower unit, said resilient pad at least partially filling the space between said upper portion of said exhaust housing cover and said lower unit.

5. The marine propulsion device of claim 4 also having a lower engine cover in surrounding relation to said powerhead and spaced from said link, said resilient pad at least partially filling the space between said lower engine cover and said link.

6. The marine propulsion device of claim 5 wherein said portion of said link comprises a pair of steering arm forks connected to a rubber mount assembly attached to said lower unit, and said resilient pad has a pair of apertures through which said forks extend.

7. A device for propelling a boat comprising a rigid assembly including a powerhead and a lower unit rigidly connected to said powerhead, an apparatus for mounting said rigid assembly to the boat and for affording pivotal steering movement of said rigid assembly with respect to the boat, said mounting apparatus comprising a kingpin, a steering linkage connecting said kingpin to said rigid assembly for effecting steering movement of said rigid assembly relative to said mounting apparatus and including a portion located in forwardly spaced relation to said lower unit and having an upper surface, and a resilient pad extending above said upper surface of said linkage portion and at least partially filling the space between said upper surface of said linkage portion and said rigid assembly.

8. The marine propulsion device of claim 7 wherein said resilient pad at least partially fills the space between the top of the kingpin and the powerhead.

9. The marine propulsion device of claim 8 wherein said resilient pad has an aperture and said link extends through said aperture.

10. The marine propulsion device of claim 9 wherein said lower unit has a cover in spaced relation thereto and said resilient pad at least partially fills the space between said lower unit cover and said lower unit.

11. The marine propulsion device of claim 10 wherein said mounting apparatus comprises a swivel bracket, and said link is pivotally connected to said swivel bracket and resiliently connected to one of said powerhead and said lower unit.

12. The marine propulsion device of claim 7 wherein said pad at least partially fills the space between said mounting apparatus and said powerhead and at least partially fills the space between said mounting apparatus and said lower unit.

13. The marine propulsion device of claim 7 wherein said pad is located substantially forwardly of said lower unit.

14. A marine propulsion device including a rigid assembly comprising a powerhead, and a lower unit rigidly connected to said powerhead, including an upper portion, and supporting a propeller shaft drivingly connected to said powerhead, an exhaust housing cover in surrounding and spaced relation to said upper portion of said lower unit, a mounting apparatus for mounting said rigid assembly to a boat, said mounting apparatus comprising a resilient linkage including a portion extending through an opening in said exhaust housing cover and having one end attached to said rigid assembly, and a resilient pad surrounding and engaging said linkage adjacent said linkage portion and at least partially filling the space between said exhaust housing cover and said upper portion of said lower unit.

15. The marine propulsion device of claim 14 and also having a lower engine cover in surrounding relation to said powerhead, wherein said mounting apparatus further comprises a swivel bracket in vertically spaced relation below said lower engine cover, and wherein said resilient pad at least partially fills the space between said lower engine cover and said swivel bracket.

* * * * *